US012403941B2

(12) United States Patent
Zäch

(10) Patent No.: US 12,403,941 B2
(45) Date of Patent: Sep. 2, 2025

(54) ASSEMBLY FOR INCREASING THE LOAD-BEARING CAPACITY OF A STRUCTURAL COMPONENT OF A RAIL VEHICLE

(71) Applicant: Siemens Mobility GmbH, Munich (DE)

(72) Inventor: Martin Zäch, Raubling (DE)

(73) Assignee: Siemens Mobility GmbH, Munich (DE)

( * ) Notice: Subject to any disclaimer, the term of this patent is extended or adjusted under 35 U.S.C. 154(b) by 636 days.

(21) Appl. No.: 17/794,706

(22) PCT Filed: Nov. 25, 2020

(86) PCT No.: PCT/EP2020/083431
§ 371 (c)(1),
(2) Date: Jul. 22, 2022

(87) PCT Pub. No.: WO2021/151544
PCT Pub. Date: Aug. 5, 2021

(65) Prior Publication Data

US 2023/0054558 A1 Feb. 23, 2023

(30) Foreign Application Priority Data

Jan. 27, 2020 (DE) ..... 10 2020 200 884.1

(51) Int. Cl.
*B61F 1/06* (2006.01)
*B61D 17/00* (2006.01)
(Continued)

(52) U.S. Cl.
CPC ..... *B61F 1/06* (2013.01); *B61D 17/00* (2013.01); *B61D 17/04* (2013.01); *B61F 1/10* (2013.01); *B61F 1/14* (2013.01); *B61D 17/043* (2013.01)

(58) Field of Classification Search
CPC ..... B61D 17/00; B61D 17/04; B61D 17/043; B61D 17/045; B61F 1/06; B61F 1/08; B61F 1/10; B61F 1/14
(Continued)

(56) References Cited

U.S. PATENT DOCUMENTS 972,467 A * 10/1910 McKeen, Jr. ..... B61D 17/20 105/407
6,227,125 B1 5/2001 Schroeder et al.
(Continued)

FOREIGN PATENT DOCUMENTS

CN 1443120 A 9/2003
CN 104057967 A 9/2014
(Continued)

OTHER PUBLICATIONS

DE 10053125 EPO translation (Year: 2002).*

*Primary Examiner* — Zachary L Kuhfuss
(74) *Attorney, Agent, or Firm* — Laurence A. Greenberg; Werner H. Stemer; Ralph E. Locher

(57) ABSTRACT

An assembly for increasing the load-bearing capacity of a structural component of a rail vehicle, in particular the tensile strength and the compressive strength. The structural component has a first connection point and a second connection point. A tensile force acting on the first connection point or a compressive force acting on the first connection point is transmitted to the second connection point. A first load path which is designed to transmit the compressive force is formed between the first connection point and the second connection point, and a second load path which is designed to transmit the tensile force is formed between the first connection point and the second connection point. The first load path and the second load path have different
(Continued)

compressive strengths, thus achieving a division of the force transmission by the different compressive strengths.

2 Claims, 3 Drawing Sheets

(51) Int. Cl.
*B61D 17/04* (2006.01)
*B61F 1/10* (2006.01)
*B61F 1/14* (2006.01)

(58) Field of Classification Search
USPC ..... 105/172, 396–421
See application file for complete search history.

(56) References Cited

U.S. PATENT DOCUMENTS

| | | | |
|---|---|---|---|
| 2004/0112246 | A1 | 6/2004 | Gain et al. |
| 2017/0305473 | A1 | 10/2017 | Mirau et al. |

FOREIGN PATENT DOCUMENTS

| | | | |
|---|---|---|---|
| CN | 106240596 | A | 12/2016 |
| CN | 107310628 | A | 11/2017 |
| DE | 855658 | C | 11/1952 |
| DE | 77507 | | 11/1970 |
| DE | 19619212 | A1 | 11/1997 |
| DE | 10053125 | A1 | 5/2002 |
| DE | 10351270 | A1 | 6/2005 |
| EP | 0881135 | A1 | 12/1998 |
| FR | 2697099 | A1 | 4/1994 |
| JP | 2011213318 | A | 10/2011 |
| WO | 2019166378 | A2 | 9/2019 |

* cited by examiner

ASSEMBLY FOR INCREASING THE LOAD-BEARING CAPACITY OF A STRUCTURAL COMPONENT OF A RAIL VEHICLE

FIELD AND BACKGROUND OF THE INVENTION

The invention relates to an assembly for increasing the load-bearing capacity of a structural component of a rail vehicle, in particular the tensile rigidity and the compressive rigidity.

The term "structural component of a rail vehicle" is understood to mean, for example but not definitively, a locomotive body, a wagon body, a frame, for example an air brake rack frame, or else a spatial structure, in which rail vehicle components are mounted or secured. This is likewise understood to mean roof structures which are configured and used for the transmission of loads.

A body of a load-bearing structure of a locomotive which is configured in various designs is called a locomotive body.

The locomotive body can be of frame construction, in the case of which attachments which are not load-bearing are attached to a load-bearing frame.

The integral all-steel construction is known as a further type of locomotive body.

In the case of railway wagons and wagons of a multiple unit, a corresponding component is called a wagon body.

A distinction is made for wagon bodies between the following designs:

In the case of what is known as the differential or shell body design, first of all a load-bearing steel or aluminum skeleton is produced, to which metal sheets which are not load-bearing are subsequently attached for paneling.

In the case of what is known as the integral design, extruded profiles are used which extend over the entire length of the body. The rigidity of the body is achieved by way of the structure of the extruded profiles. No additional, load-bearing elements are required, and a lightweight design is made possible as a result.

In the case of what is known as the composite design which is similar to the differential design, trim panels which are not load-bearing are attached to a load-bearing body frame made from metallic materials. In contrast to the differential design, these trim panels consist of non-metallic materials.

In the recent past, the bodies have been increasingly optimized in accordance with safety aspects in the case of accidents.

Here, the structural component is dimensioned in such a way that the structural component durably withstands loads which often alternate and act on the structural component.

These loads are understood to be, in particular, tensile forces and compressive forces.

It is customary for respective solutions to be developed for different use areas of a structural component, in order to durably dimension the structural component in view of the alternating loads.

Thus, for example, a locomotive body is dimensioned in a manner which is dependent on whether the associated locomotive is to be used in heavy duty freight transport or in passenger transport.

This obstructs an aim of a "universal locomotive", however, the body construction of which is to be at least partially or completely independent of the intended use of the locomotive.

In the case of locomotives, especially double traction, that is to say moving with two locomotives, and multiple traction, that is to say moving with more than two locomotives, are critical for the strength of the locomotive body.

In these cases, high tensile and compressive forces which alternate with one another act on a locomotive body under consideration. The force to be transmitted by the locomotives varies. It is the case for a locomotive combination which heads a train that the locomotive which is coupled to the wagon combination has to bear the maximum forces, whereas the locomotive which heads the train has to bear the lowest forces.

In order to durably face these forces, locomotive bodies are of mechanically correspondingly solid dimensions in terms of their construction and are of correspondingly solid configuration in terms of the material which is used.

This leads to weight problems, however, in particular in the case of multiple system locomotives which are configured for transnational operation.

FIG. 3 shows a locomotive body LOK3 as a structural component as known prior art.

A tensile force FZ acts at a first connector point ASP1 on the locomotive body LOK3.

A compressive force FD acts alternately to the tensile force FZ on the locomotive body LOK3, likewise at the first connector point ASP1.

The locomotive body LOK3 is of solid configuration with regard to structure, material and weight, and transmits the tensile force FZ or the compressive force FD to a second connector point ASP2.

As a result of the configuration, the locomotive body LOK3 acts as a first load path LPF1, the first load path LPF1 being realized, in particular, by way of a frame RAH of the locomotive body LOK3.

The two forces FZ, FD are transmitted between the connector points ASP1, ASP2 via the first load path LPF1 by way of the locomotive body LOK3.

In the case of the locomotive body LOK3, for example, a combination of coupling hooks and buffers of the associated locomotive forms the respective connector point ASP1 and ASP2.

SUMMARY OF THE INVENTION

It is the object of the present invention to specify an assembly for increasing the load-bearing capacity of a structural component of a rail vehicle, by way of which assembly the abovementioned problems with regard to the weight and the durability of the structural component are minimized.

This object is achieved by way of the features of claim 1 as claimed.

Advantageous developments are specified in the dependent claims.

The invention relates to an assembly for increasing the load-bearing capacity of a structural component of a rail vehicle.

The structural component has a first connector point and a second connector point.

A first load path is arranged between the two connector points. A force which acts at the first connector point is transmitted via the first load path to the second connector point.

The first load path is configured for the transmission of compressive forces, and is optimized in this regard and is also mainly used for this purpose.

In addition to the first load path, a second load path is arranged between the two connector points.

The two load paths of the structural component act parallel to one another, but are functionally separate.

The second load path is configured for the transmission of tensile forces, is optimized in this regard and is also mainly used for this purpose.

This division of the transmission of forces is achieved by way of different rigidities of the two load paths.

The first load path is compression-rigid or is configured as a compression-rigid construction. For example, this is a frame which is manufactured from metal or from steel and is an integrated constituent part of the structural component.

In the case of the transmission of the compressive force which has a predefined value, the first load path of compression-rigid configuration is not deformed or is deformed merely to a minimum extent, that is to say within predefined and tolerable limits.

The second load path contains tensile elements, the compressive rigidity of which is considerably smaller in relation to the first load path or in the case of which the tensile elements are configured without compressive rigidity.

The tensile elements are configured, for example, as cables which are preferably manufactured from Kevlar or from carbon fiber.

In the case of the transmission of the tensile force which has a predefined value, the second load path is deformed within predefined and tolerable limits.

On account of the minimized or missing compressive rigidity in the case of the second load path, merely negligible compressive forces or no compressive forces are transmitted here.

Therefore, the first load path is relieved of tensile forces and can be reduced in terms of its dimensions or can absorb higher compressive forces with consistent dimensions.

It is one decisive advantage that higher forces can be transmitted in the case of an identical weight of the locomotive body.

In the case of a locomotive body as structural component, the first load path consists, for example, of elements of the classically constructed locomotive body, for example of the frame of the locomotive body. This frame can be optimized with regard to weight and the transmission of compressive force.

In the case of the locomotive body, for example, a combination of coupling hooks and buffers of the associated locomotive forms the respective connector point, via which the forces act on the locomotive body or are introduced into the locomotive body.

The present invention makes smaller dimensioning of the structural component with regard to the weight possible and at the same time increases the long-term stability.

As a result of the present invention, respective optimized load paths are made available or are implemented for the forces and for the alternating loads which act on the structural component. As a result, higher forces can be transmitted in the long term, without a failure of the structural component occurring.

As a result of the present invention, higher forces can be transmitted in the case of an unchanged embodiment of the structural component. This is made possible by the respective, optimized load paths.

The optimization and the possible weight saving open up new construction concepts which are optimized with regard to the manufacturing costs and which additionally allow a greater versatility of a structural component.

BRIEF DESCRIPTION OF THE FIGURES

In the following text, the present invention will be explained in greater detail by way of example on the basis of the drawing, in which.

DETAILED DESCRIPTION OF THE INVENTION

Figure 1:
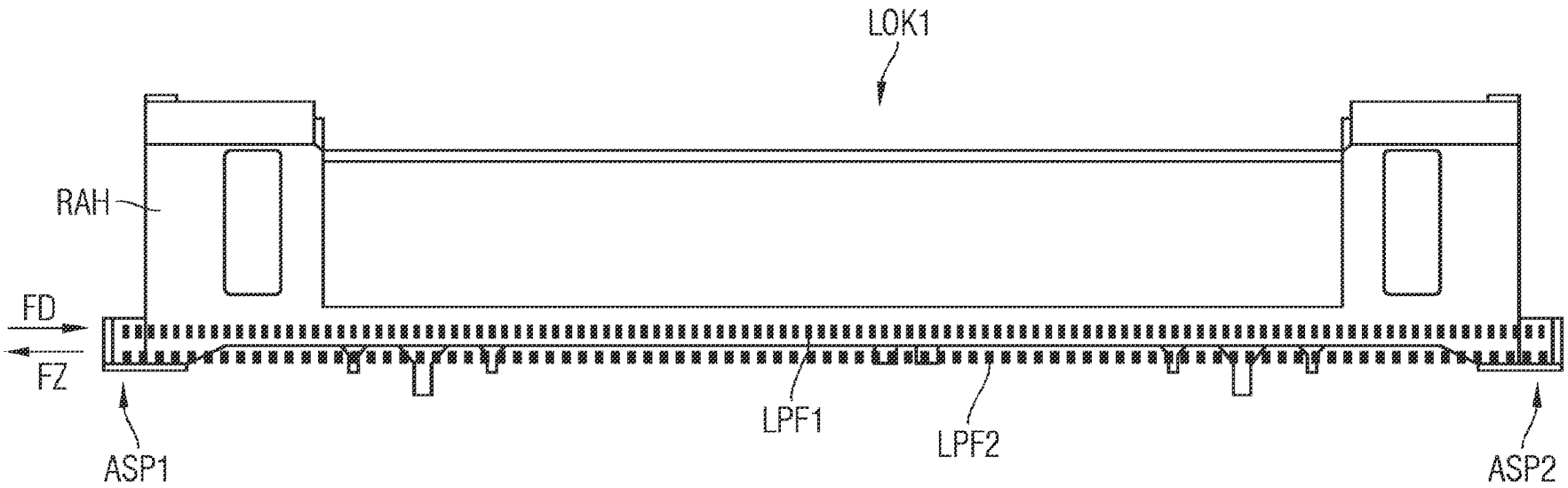
FIG. 1 shows the invention on the basis of an outline representation of a locomotive body of a rail vehicle.

FIG. 1 shows the invention on the basis of an outline illustration of a locomotive body LOK1 of a rail vehicle.

A tensile force FZ acts at a first connector point ASP1 on the locomotive body LOK1.

Correspondingly, a compressive force FD acts in an alternating manner with the tensile force FZ at the first connector point ASP1 on the locomotive body LOK1.

Via load paths LPF1, LPF2 which are described in the following text, the locomotive body LOK1 transmits the tensile force FZ and the compressive force FD from the first connector point ASP1 to a second connector point ASP2.

The compressive force FD is transmitted via a first load path LPF1 which is arranged between the two connector points ASP1, ASP2.

The tensile force FZ is transmitted via a second load path LPF2 which is arranged between the two connector points ASP1, ASP2.

The two load paths LPF1, LPF2 are separate in terms of their functionality, but act in a supplementary or parallel manner with respect to one another.

The division of the described transmission of force is achieved by way of different rigidities of the two load paths LPF1, LPF2.

The first load path LPF1 is configured as a compression-rigid construction. As stated in the above text, this is, for example, a frame RAH which is manufactured from metal or from steel and is an integrated constituent part of the structural component or the locomotive body LOK1.

Therefore, the first load path LPF1 is optimized and configured for the transmission of compressive forces, and is correspondingly mainly used for this purpose.

The second load path LPF2 contains tensile elements without compressive rigidity. The tensile elements are configured, for example, as cables which are in turn preferably manufactured from Kevlar or from carbon fiber.

Therefore, the second load path LPF2 is optimized and configured for the transmission of tensile forces, and is correspondingly exclusively used for this purpose.

The tensile force FZ which acts on the locomotive body LOK1 is transmitted by way of the tensile elements or cables of the second load path LPF2 between the two connector points ASP1, ASP2. This takes place with a relatively low deformation of the tensile elements.

The compressive force FD which acts on the locomotive body LOK1 is transmitted between the two connector points ASP1, ASP2 by way of the first load path LPF1 which is of compression-rigid configuration. This takes place without deformation of the elements which are involved (here, the frame RAH) of the locomotive body LOK1.

In the case of the locomotive body LOK1, for example, a combination of coupling hooks and buffers of the associated locomotive forms the first connector point ASP1 and the connector point ASP2.

Figure 2:
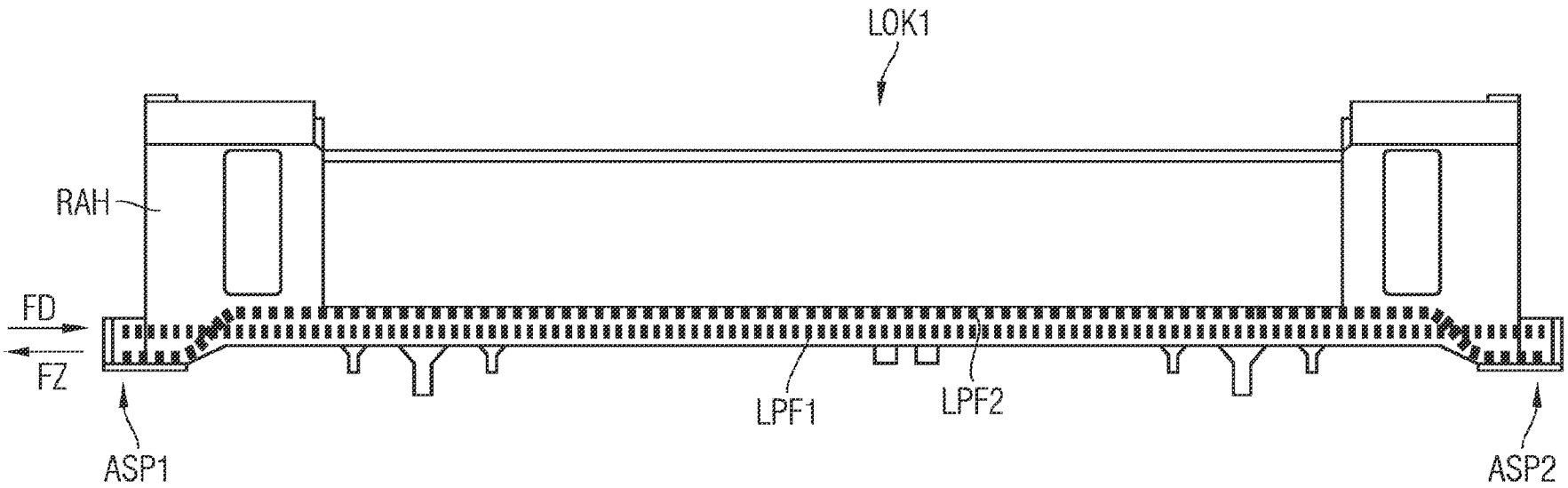
FIG. 2 shows a specific illustration of the invention with reference to FIG. 1.
Figure 3:
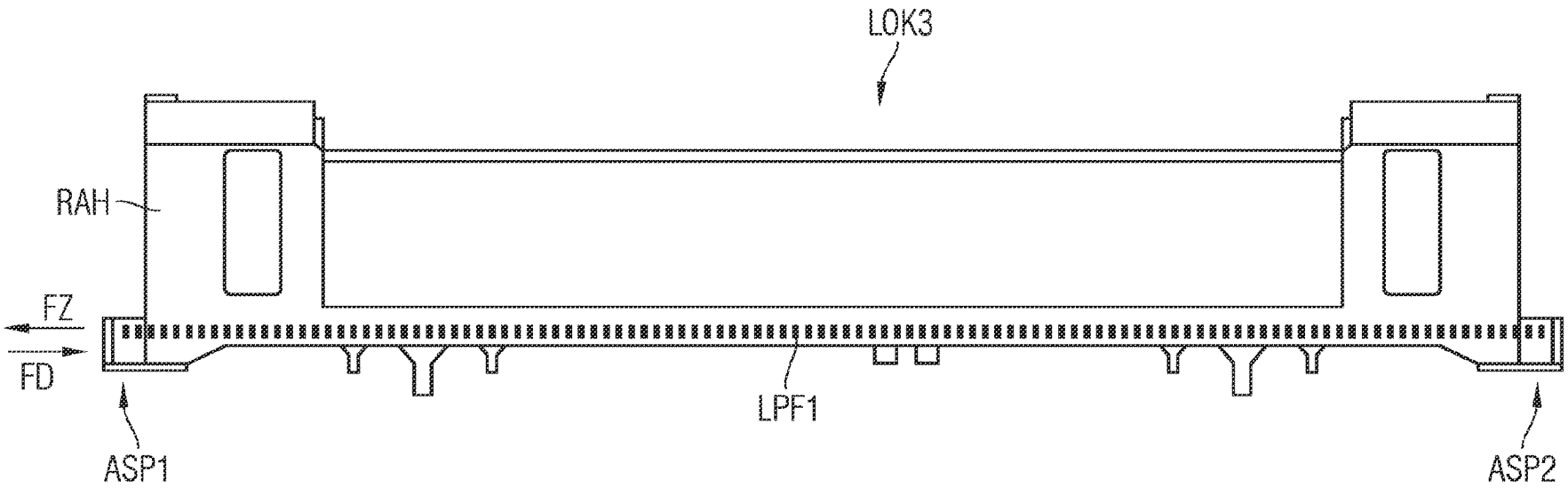
FIG. 3 shows the previously known prior art described in the introduction.

FIG. 2 shows a specific illustration of the invention with reference to FIG. 1.

In the embodiment which is shown here, the cables of the second load path LPF2 are deflected in the locomotive body LOK1 at some points for structural reasons. This is symbolized by the bent shape of the second load path LPF2.

In a further preferred embodiment, additional tensile forces are introduced into the second load path LPF2, for example via corresponding connecting points of drawbars, push-pull link bars or pivot pins to the second load path LPF2.

The invention claimed is:

1. An assembly for increasing a load-bearing capacity of a locomotive body, the assembly comprising:

a first connector point and a second connector point at the locomotive body, the first and second connector points being formed by a combination of coupling hooks and buffers of an associated locomotive and wherein a tensile force acting at said first connector point or a compressive force acting at said first connector point is transmitted to said second connector point;

a first load path extending between said first connector point and said second connector point being configured for a transmission of the compressive force;

a second load path extending between said first connector point and said second connector point being configured for a transmission of the tensile force;

said first and second load paths acting parallel to one another, but being functionally separate from one another;

said first and second load paths having mutually different compressive rigidities, thus achieving a division of the transmission of the tensile force and the transmission of the compressive force by way of the different compressive rigidities;

said first load path having a compression-rigid configuration, with said first load path being formed by a frame of the locomotive body and the frame being an integrated constituent part of the locomotive body; and said second load path being formed by cables forming tensile elements substantially without compressive rigidity.

2. The assembly according to claim 1, wherein said cables are manufactured from Kevlar® or from carbon fiber.

* * * * *